United States Patent [19]

Teramura et al.

[11] Patent Number: 4,457,279

[45] Date of Patent: Jul. 3, 1984

[54] AIR-FUEL RATIO CONTROL DEVICE OF A VARIABLE VENTURI-TYPE CARBURETOR

[75] Inventors: Mitsuyoshi Teramura; Masatami Takimoto, both of Toyota; Takeru Yasuda, Mikio Minoura, both of Nagoya, all of Japan

[73] Assignees: Toyota Jidosha Kabushiki Kaisha and Aisan

[21] Appl. No.: 405,274

[22] Filed: Aug. 4, 1982

[30] Foreign Application Priority Data

Feb. 16, 1982 [JP] Japan ..... 57-022048

[51] Int. Cl.[3] ..... F02B 33/00

[52] U.S. Cl. ..... 123/439; 261/44 C

[58] Field of Search ..... 123/440, 439, 438; 261/44 C

[56] References Cited

U.S. PATENT DOCUMENTS

| | | | |
|---|---|---|---|
| 3,906,910 | 9/1975 | Szlaga | 123/439 |
| 4,039,638 | 8/1977 | Hill | 123/438 |
| 4,085,716 | 4/1978 | Minami | 123/440 |
| 4,091,781 | 5/1978 | Mituyasu | 123/440 |
| 4,100,234 | 7/1978 | Lindberg | 123/440 |
| 4,111,170 | 9/1978 | Nakajima | 123/440 |
| 4,173,956 | 11/1979 | Ikeura | 123/440 |
| 4,314,535 | 2/1982 | Takeuchi | 123/439 |
| 4,369,749 | 1/1983 | Sugi | 123/439 |

*Primary Examiner*—Ronald B. Cox

*Attorney, Agent, or Firm*—Finnegan, Henderson, Farabow, Garrett & Dunner

[57] ABSTRACT

A variable venturi-type carburetor comprising a main fuel passage which is open to the intake passage of the carburetor. An air bleed passage is connected to the main fuel passage. The inlet of the air bleed passage is divided into a first passage and a second passage. A first control valve and a first jet are arranged in the first passage. A second control valve and a second jet are arranged in the second passage. The second jet has a flow area which is larger than that of the first jet. The first control valve opens the first passage only when the engine is operating under an idling state. The second control valve opens the second passage only during the cruising operation of a vehicle.

10 Claims, 3 Drawing Figures

AIR-FUEL RATIO CONTROL DEVICE OF A VARIABLE VENTURI-TYPE CARBURETOR

BACKGROUND OF THE INVENTION

The present invention relates to a variable venturi-type carburetor.

In an engine, it is preferable that a lean air-fuel ratio be used when the engine is operating under an idling state in order to promote a lower specific fuel consumption; that another lean air-fuel mixture, which is far leaner than the lean air-fuel mixture used at the time of idling, be used in the normal cruising operation of a vehicle in which cruising operation a stable combustion can be obtained as compared with the combustion obtained at the time of idling; and that a rich air-fuel mixture be used at the time of acceleration in order to obtain good acceleration. Consequently, it is necessary to change the air-fuel ratio so that at least three separate air-fuel ratios are obtained in accordance with the operation condition of the engine. In a conventional fixed venturi-type carburetor, in order to obtain such separate three air-fuel ratios, control of the air bleed of the slow fuel system, control of the air bleed of the main fuel system and the control for increasing the amount of fuel fed from the main fuel system are carried out. Consequently, in a conventional carburetor, the control system of air-fuel ratio becomes complicated. Thus, problems occur in that the reliability of the control system will deteriorate, and that the manufacturing cost of the control system will be increased.

SUMMARY OF THE INVENTION

An object of the present invention is to provide a variable venturi-type carburetor capable of simplifying the construction thereof and capable of changing the air-fuel ratio so that separate three air-fuel ratios can be obtained.

According to the present invention, there is provided an air-fuel ratio control device of a variable venturi-type carburetor having an intake passage, a suction piston movable in said intake passage, a float chamber, a fuel passage interconnecting the float chamber to the intake passage, a needle fixed onto the suction piston and extending through the fuel passage, and a throttle valve arranged in the intake passage located downstream of the suction piston, said device comprising: an air passage having an air inlet and an air outlet which is open to the fuel passage; a first air bleed passage having an air inlet and an air outlet connected to the air inlet of said air passage, the air inlet of said first air bleed passage being open to the atmosphere; a first jet arranged in said first air bleed passage and defining a restricted opening therein; a normally closed first valve means arranged in said first air bleed passage and actuated in response to the operating condition of an engine for opening said first air bleed passage to feed air into the fuel passage from said first air bleed passage via said first jet only when the engine is operating under an idling state; a second air bleed passage having an air inlet and an air outlet connected to the air inlet of said air passage, the air inlet of said second air bleed passage being open to the atmosphere; a second jet arranged in said second air bleed passage and defining therein a restricted opening which has a flow area larger than that of the restricted opening of said first jet; and normally closed second valve means arranged in said second air bleed passage and actuated in response to the operating condition of the engine for opening said second air bleed passage to feed air into the fuel passage from said second air bleed passage via said second jet only when the cruising operation of a vehicle is being carried out.

The present invention may be more fully understood from the description of a preferred embodiment of the invention set forth below, together with the accompanying drawings.

DESCRIPTION OF A PREFERRED EMBODIMENT

Figure 1:
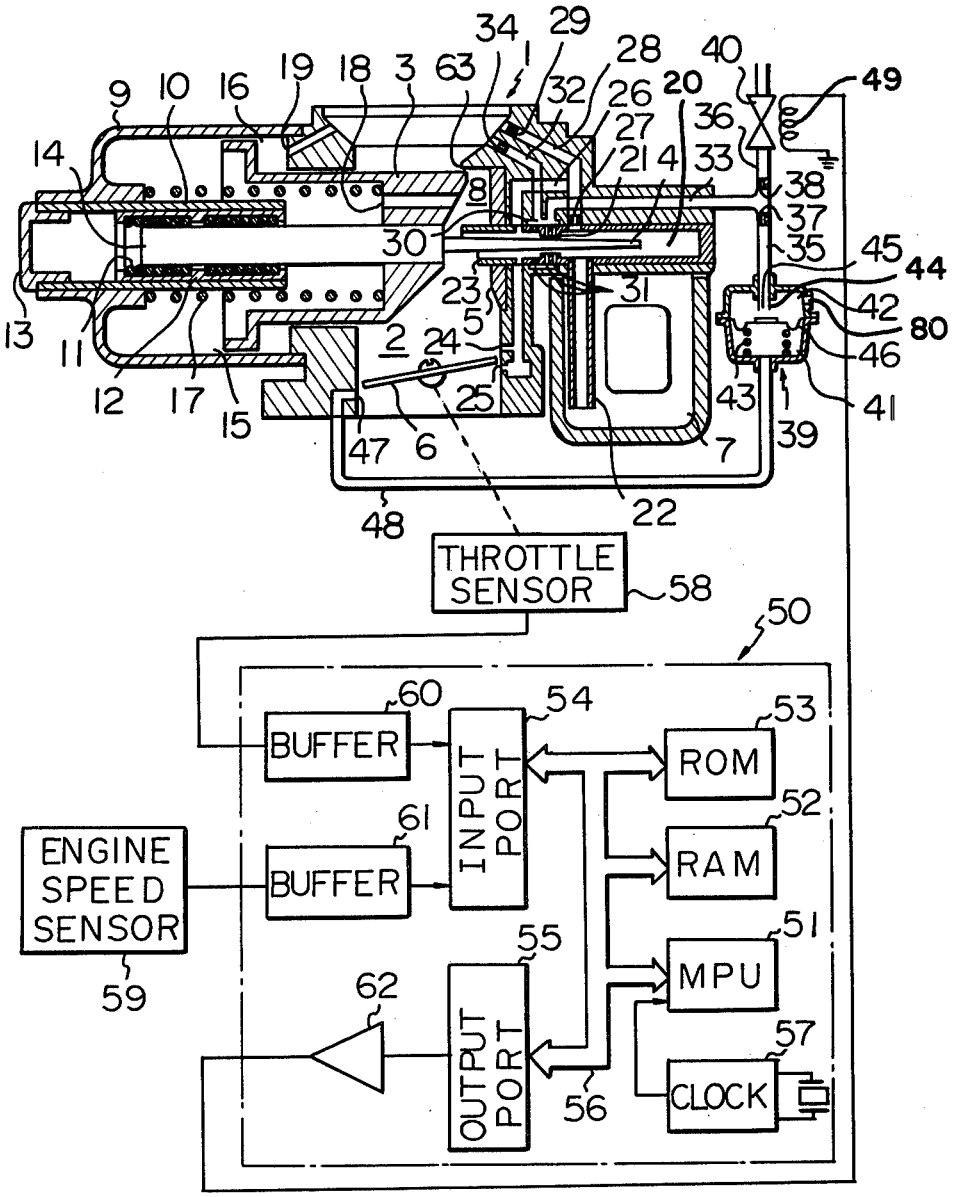
FIG. 1 is a cross-sectional side view of a variable venturi-type carburetor according to the present invention.

Referring to FIG. 1, reference numeral 1 designates a carburetor body, 2 a vertically-extending air intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13.

On the other hand, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 towards the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

On the other hand, a fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8. In addition, the upper half of the tip portion of the nozzle 23 projects from the lower half of the tip portion of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

A slow port 24 and an idle port 25 are formed on the inner wall of the intake passage 2 in the vicinity of the throttle valve 6 and connected to the fuel passage 20 via a slow fuel passage 26 and a slow jet 27. The slow fuel passage 26 is connected via an air bleed passage 28 to the intake passage 2 located upstream of the suction piston 3, and an air bleed jet 29 is inserted into the air bleed passage 28. An annular air chamber 30 is formed around the metering jet 21 and has a plurality of air bleed bores 31 which are open to the interior of the metering jet 21 and the portion of the fuel passage 20 located downstream of the metering jet 21. A pair of air bleed passages 32, 33 is connected to the annular air chamber 30. The air bleed passage 32 is connected to the intake passage 2 located upstream of the suction piston 3, and an air bleed jet 34 is inserted into the air bleed passage 32.

In accordance with the present invention the air bleed passage 33 is divided into a first air bleed passage 35 and a second air bleed passage 36. A first jet 37 defining a restricted opening therein is inserted into the first air bleed passage 35, and a second jet 38, defining therein a restricted opening which is larger than that of the first jet 37, is inserted into the second air bleed passage 36. In addition, the first air bleed passage 35 is connected to a first control valve 39, and the second air bleed passage 36 is connected to a second control valve 40. The first control valve 39 comprises a vacuum chamber 41 and an atmospheric pressure chamber 42 (connected to the atmosphere via port 80) which are separated by a diaphragm 46, and a compression spring 43 for biasing the diaphragm 46 towards the atmospheric pressure chamber 42, is arranged in the vacuum chamber 41. An air introduction pipe 44, connected to the first air bleed passage 35, projects into the atmospheric pressure chamber 42 and has an open end 45 which faces the diaphragm 46. The vacuum chamber 41 of the first control valve 39 is connected via a vacuum conduit 48 to a vacuum port 47 which is formed on the inner wall of the intake passage 2 in the vicinity of the throttle valve 6. The vacuum port 47 is open to the intake passage 2 located downstream of the throttle valve 6 when the throttle valve 6 is in the idling position as illustrated in FIG. 1, but is open to the intake passage 2 located upstream of the throttle valve 6 when the throttle valve 6 is opened. Consequently, when the throttle valve 6 is in the idling position as illustrated in FIG. 1, since vacuum acts on the vacuum chamber 41 of the first control valve 39, the diaphragm 46 moves downward against the compression spring 43. Consequently, at this time, the first air bleed passage 35 is open to the atmosphere. When the throttle valve 6 is opened, since the level of vacuum in the vacuum chamber 41 becomes small, the diaphragm 46 moves upward due to the spring force of the compression spring 43. As a result of this, since the diaphragm 46 closes the open end 45 of the air introduction pipe 44, the first air bleed passage 35 is disconnected from the atmosphere.

On the other hand, the second control valve 40 is an electromagnetic valve actuated by a solenoid 49, and the solenoid 49 is connected to the output terminal of an electronic control unit 50. The electronic control unit 50 is constructed as a digital computer and comprises a microprocessor (MPU) 51 executing the arithmetic and logic processing, a random-access memory (RAM) 52, a read-only memory (ROM) 53 storing a predetermined control program and an arithmetic constant therein, an input port 54 and an output port 55 are interconnected to each other via a bidirectional bus 56. In addition, the electronic control unit 50 comprises a clock generator 57 generating various clock signals. A throttle sensor switch 58, which is operated in response to a change in the degree of opening of the throttle valve 6, and an engine speed sensor 59 are connected to the input port 54 via buffer amplifiers 60 and 61, respectively. The throttle switch 58 is turned on when the degree of opening of the throttle valve 58 becomes larger than a predetermined degree, and the output signal of the throttle switch 58 is input into the MPU 51 via the input port 54 and the bus 56. The engine speed sensor 59 produces an output pulse everytime the crankshaft (not shown) of the engine is rotated by a predetermined crank angle, and the output pulse is input into the MPU 51 via the input port 54 and the bus 56. The output port 56 is connected to the solenoid 49 of the second control valve 40 via a power amplifier 62.

Figure 3:
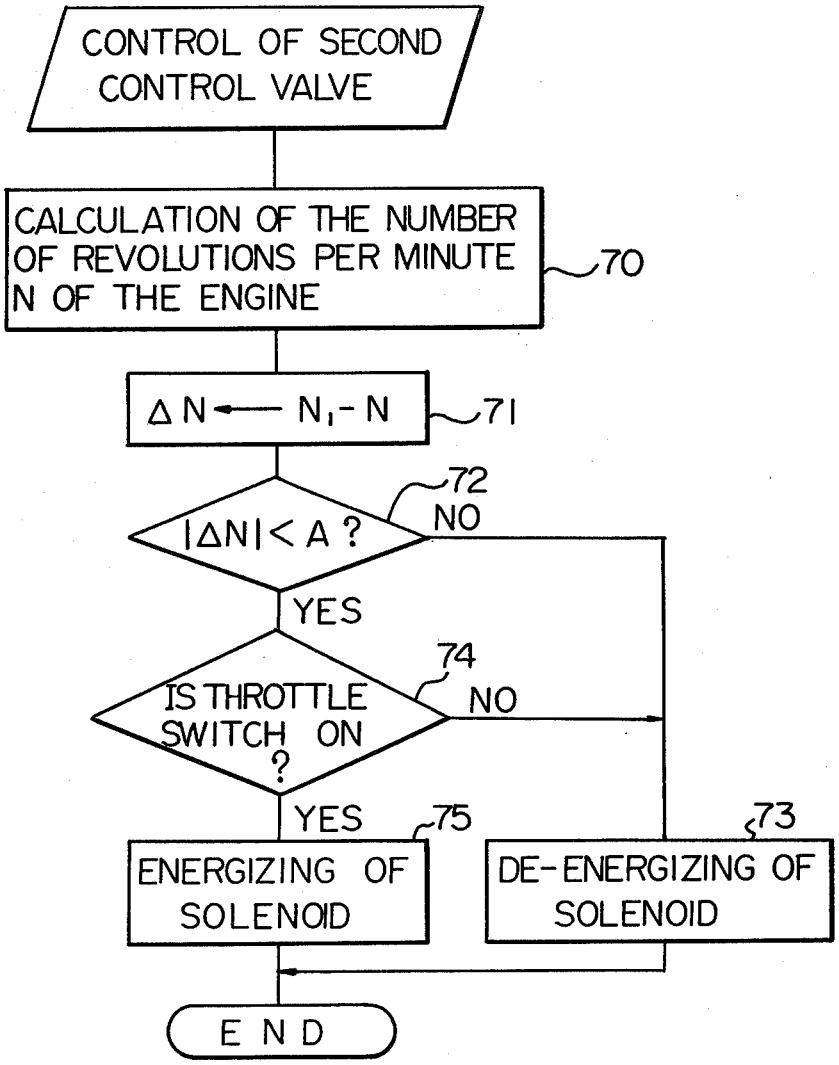
FIG. 3 is a flow chart.

The operation of the electronic control unit 50 will be hereinafter described with reference to a flow chart illustrated in FIG. 3. Referring to FIG. 3, initially, in step 20, the number of revolutions per minute N of the engine is calculated from the output pulse of the engine speed sensor 59. The number of revolutions N thus calculated is stored in a predetermined address in the RAM 52. Then, in step 71, the number of revolutions N is subtracted from the number of revolutions $N_1$ which was calculated in the previous processing cycle, and the result of the subtraction is put into $\Delta N$. Then, in step 72, it is determined whether the absolute value of $\Delta N$ is smaller than a predetermined fixed value A or not. If $\Delta N$ is not smaller than A, the routine goes to step 73. On the other hand, if it is determined in step 72 that $\Delta N$ is smaller than A, the routine goes to step 74, and it is determined whether the throttle switch 58 produces an on signal or not. If the throttle switch 58 does not produce an on signal, the routine goes to step 73. In step 73, data, indicating that the solenoid 49 of the second control valve 40 should be de-energized, is written in the output port 55. On the other hand, if it is determined in step 74 that the throttle switch 58 produces an on signal, the routine goes to step 75. In step 75, data, indicating that the solenoid 49 should be energized, is written in the output port 55. Consequently, the solenoid 49 is energized when $\Delta N$ is smaller than A and when the degree of opening of the throttle valve 6 is larger than the predetermined degree. That is, the solenoid 49 is energized when the normal cruising operation of a vehicle is being carried out. In addition, the solenoid 49 is de-energized for operation of a vehicle in modes other than the normal cruising operation. When the solenoid 49 is energized, the second control valve 40 opens the second air bleed passage 36 so that the second air bleed passage 36 opens to the atmosphere. When the solenoid 49 is de-energized, the second air bleed passage 36 is disconnected from the atmosphere.

As illustrated in FIG. 1, a raised wall 63, projecting horizontally into the intake passage 2, is formed at the upper end of the spacer 5, and a flow control is effected between the raised wall 63 and the tip end portion of the suction piston 3. When the engine is started, air flows downwards within the intake passage 2. At this time, since the air flow is restricted between the suction piston 3 and the raised wall 63, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

Figure 2:
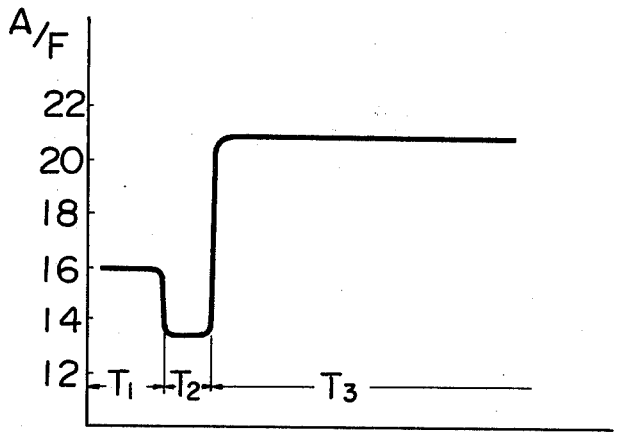
FIG. 2 is a diagram illustrating a change in the air-fuel ratio.

When the throttle valve 6 is in the idling position as illustrated in FIG. 1, the first air bleed passage 35 is open to the atmosphere as mentioned previously. At this time, since the throttle switch 58 produces an off signal, the solenoid 49 of the second control valve 40 is de-energized. Thus, the second control valve 40 shuts off the second air bleed passage 36. Consequently, at this time, air is fed into the annular air chamber 30 from the air bleed passage 32 and the first air bleed passage 35, and then fed into the fuel passage 20 via the air bleed bores 31. At this time, the air-fuel ratio (A/F) of fuel-air mixture fed into the cylinder of the engine becomes equal to about 16:1 as illustrated by the section $T_1$ in FIG. 2. In FIG. 2, the ordinate A/F indicates the air-fuel ratio, and the abscissa T indicates time.

When the throttle valve 6 is opened in order to accelerate the engine, the diaphram 46 of the second control valve 49 closes the open end 45 of the air introduction pipe 44. In addition, at this time, since the number of revolutions per minute of the engine is rapidly increased, it is determined in step 72 in FIG. 3 that the absolute value of $\Delta N$ is not smaller than A. Thus, the second control valve 40 closes the second air bleed passage 36. Consequently, at this time, air is fed into the annular air chamber 30 from only the air bleed passage 32. Therefore, since the amount of air fed into the fuel passage 20 from the air bleed bores 31 is reduced as compared with the case where the engine is operating under an idling state, the air-fuel ratio becomes equal to about 13.5:1 as illustrated by the section $T_2$ in FIG. 2.

After this, when the cruising operation of a vehicle is started, the second control valve 40 opens the second air bleed passage 36 so that the second air bleed passage 36 is open to the atmosphere. Consequently, at this time, since the flow area of the restricted opening of the second jet 38 is larger than that of the restricted opening of the first jet 37, the amount of air fed into the fuel passage 20 from the air bleed bores 31 is increased as compared with the case where the engine is operating under an idling state. As a result of this, the air-fuel ratio becomes equal to about 21:1 as illustrated by the section $T_3$ in FIG. 2.

According to the present invention, by merely controlling the amount of air fed into fuel which is fed into the intake passage 2 from the main fuel system, that is, from the nozzle 23, it is possible to obtain separate three air-fuel ratios. Consequently, since the construction of the control system of air-fuel ratio becomes simple, it is possible to improve the reliability of the control system and reduce the manufacturing cost thereof.

While the invention has been described with reference to a specific embodiment chosen for the purpose of illustration, it should be apparent that numerous modifications can be made thereto by those skilled in the art without departing from the basic concept and scope of the invention.

We claim:

1. An air-fuel ratio control device of a variable venturi-type carburetor for a vehicle engine, the carburetor having an intake passage, a suction piston movable in said intake passage, a float chamber, a fuel passage interconnecting the float chamber to the intake passage, a needle fixed onto the suction piston and extending through the fuel passage, and a throttle valve arranged in the intake passage located downstream of the suction piston, said device comprising:

(a) an air passage having an air inlet and an air outlet which is open to the fuel passage;

(b) means for providing a predetermined air flow rate during engine idle conditions, including (i) a first air bleed passage having an air inlet and an air outlet connected to the air inlet of said air passage, the air inlet of said first air bleed passage being open to the atmosphere;

(ii) a first jet arranged in said first air bleed passage and defining a restricted opening therein;

(iii) a normally closed first valve means arranged in said first air bleed passage and actuated in response to the operating condition of an engine for opening said first air bleed passage to feed air into the fuel passage from said first air bleed passage via said first jet only when the engine is operating under an idling state;

(c) means for providing a predetermined air flow rate during engine cruising conditions, including (i) a second air bleed passage having an air inlet and an air outlet connected to the air inlet of said air passage, the air inlet of said second air bleed passage being open to the atmosphere;

(ii) a second jet arranged in said second air bleed passage and defining therein a restricted opening which has a flow area larger than that of the restricted opening of said first jet; and (iii) normally closed second valve means arranged in said second air bleed passage and actuated in response to the operating condition of the engine for opening said second air bleed passage to feed air into the fuel passage from said second air bleed passage via said second jet only when the cruising operation of the vehicle is carried out.

2. A device according to claim 1, wherein said first valve means comprises a vacuum port which is open to the intake passage, and a vacuum operated first valve actuated in response to a change in vacuum acting on said vacuum port of controlling the opening operation of said first air bleed passage.

3. A device according to claim 2, wherein said vacuum port is formed on an inner wall of the intake passage and is open to the intake passage located downstream of the throttle valve when the throttle valve is in the idling position for opening said first air bleed passage, said vacuum port being open to the intake passage located upstream of the throttle valve when the throttle valve is opened for shutting off said first air bleed passage.

4. A device according to claim 2, wherein said vacuum operated first valve comprises a diaphragm apparatus having a vacuum chamber which is connected to said vacuum port.

5. A device according to claim 1, wherein said second valve means comprises a detecting apparatus detecting that the cruising operation of a vehicle is being carried out and producing a control signal, and a second valve actuated in response to said control signal for controlling the opening operation of said second air bleed passage.

6. A device according to claim 5, wherein said detecting apparatus comprises a throttle switch operated in response to a change in the degree of opening of the throttle valve and producing an output signal which indicates that the degree of opening of the throttle valve is larger than a predetermined degree, an engine speed sensor producing an output signal which indicates the engine speed, and an electronic control unit actuated in response to the output signal of said throttle switch and the output signal of said engine speed sensor and determining whether the change in the engine speed per unit time is less than a predetermined value, said electronic control unit producing said control signal for opening said second air bleed passage when the degree of opening of the throttle valve is larger than the predetermined degree and when said change in the engine speed is less than the predetermined value and for shutting off said second air bleed passage when the degree of opening of the throttle valve is smaller than the predetermined degree or when said change in the engine speed is larger than the predetermined value.

7. A device according to claim 5, wherein said second valve is an electromagnetically controlled valve.

8. A device according to claim 1, wherein said device comprises another air bleed passage continuously connecting the fuel passage to the atmosphere.

9. A device according to claim 1, wherein the air outlet of said air passage is formed on an inner circumferential wall of said metering jet.

10. A device according to claim 1, wherein a raised wall is formed on an inner wall of the intake passage, which faces a tip face of the suction piston, at a position located upstream of and adjacent to the suction piston, the tip face of the suction piston having an upstream end portion which cooperates with said raised wall for controlling the amount of air flowing within the intake passage.

* * * * *

UNITED STATES PATENT AND TRADEMARK OFFICE

CERTIFICATE OF CORRECTION

PATENT NO. : 4,457,279

DATED : July 3, 1984

INVENTOR(S) : Mitsuyoshi Teramura et al.

It is certified that error appears in the above—identified patent and that said Letters Patent is hereby corrected as shown below:

On the title page:

Please change the name of the Assignees from

"Toyota Jidosha Kabushiki Kaisha and Aisan" to

--Toyota Jidosha Kabushiki Kaisha and Aisan Industry Co., Ltd.--

Signed and Sealed this

*Twenty-fifth* Day of *December 1984*

[SEAL]

*Attest:*

*Attesting Officer*

GERALD J. MOSSINGHOFF

*Commissioner of Patents and Trademarks*